US007028435B2

(12) United States Patent
Walker et al.

(10) Patent No.: US 7,028,435 B2
(45) Date of Patent: Apr. 18, 2006

(54) MULTI-STORY CONCRETE SLAB CONSTRUCTION

(75) Inventors: Crockett Jackson Walker, Sarasota, FL (US); Richard Bryan Beavers, Jacksonville, FL (US)

(73) Assignee: Climatized Self-Storage Const. Co., Fernandina Beach, FL (US)

( * ) Notice: Subject to any disclaimer, the term of this patent is extended or adjusted under 35 U.S.C. 154(b) by 0 days.

(21) Appl. No.: 10/704,298

(22) Filed: Nov. 7, 2003

(65) Prior Publication Data

US 2005/0097844 A1 May 12, 2005

(51) Int. Cl.
*E04H 1/00* (2006.01)

(52) U.S. Cl. ..... 52/236.5; 52/745.05; 52/236.9; 52/414

(58) Field of Classification Search ..... 52/261–274, 52/414, 236.9, 79.13, 301, 294
See application file for complete search history.

(56) References Cited

U.S. PATENT DOCUMENTS

| | | | | | |
|---|---|---|---|---|---|
| 2,003,670 | A | * | 6/1935 | Walker | 52/236.6 |
| 3,110,982 | A | | 11/1963 | Besinger | |
| 3,378,971 | A | | 4/1968 | Singer et al. | |
| 3,594,971 | A | | 7/1971 | Hughes | |
| 3,824,750 | A | | 7/1974 | Antoniou | |
| 3,867,805 | A | * | 2/1975 | Mikami et al. | 52/742.15 |
| 3,979,865 | A | * | 9/1976 | Boot et al. | 52/236.5 |
| 4,019,293 | A | * | 4/1977 | Armas | 52/79.11 |
| 4,060,948 | A | * | 12/1977 | Brownlee | 52/236.8 |
| 4,074,487 | A | * | 2/1978 | Daniels et al. | 52/236.3 |
| 4,081,936 | A | | 4/1978 | Wise | |
| 4,100,713 | A | | 7/1978 | Shoe | |
| 4,114,335 | A | * | 9/1978 | Carroll | 52/336 |
| 4,330,970 | A | | 5/1982 | Bonink | |
| 4,435,927 | A | * | 3/1984 | Umezu et al. | 52/79.13 |
| 4,457,115 | A | * | 7/1984 | Grearson et al. | 52/73 |
| 4,507,901 | A | * | 4/1985 | Carroll | 52/302.3 |
| 4,741,138 | A | * | 5/1988 | Rongoe, Jr. | 52/334 |
| 4,768,938 | A | * | 9/1988 | Greeson | 425/62 |
| 4,785,593 | A | * | 11/1988 | Munoz, Jr. | 52/126.1 |
| 4,895,548 | A | * | 1/1990 | Holland et al. | 446/476 |
| 4,901,491 | A | * | 2/1990 | Phillips | 52/274 |
| 5,373,675 | A | * | 12/1994 | Ellison, Jr. | 52/320 |
| 5,412,913 | A | * | 5/1995 | Daniels et al. | 52/79.13 |
| 5,444,957 | A | * | 8/1995 | Roberts | 52/745.05 |
| 5,737,895 | A | | 4/1998 | Perrin | |
| 5,906,076 | A | * | 5/1999 | Mc Manus | 52/126.5 |
| 5,941,035 | A | * | 8/1999 | Purse | 52/263 |
| 5,992,123 | A | * | 11/1999 | Kies | 52/719 |

(Continued)

*Primary Examiner*—Peter M. Cuomo
*Assistant Examiner*—Erika Garrett
(74) *Attorney, Agent, or Firm*—Thomas C. Saitta

(57) ABSTRACT

A system and method of constructing multi-story buildings having poured-in-place concrete floors for the upper floors, wherein a set of lower posts is erected, the lower posts having horizontal upper plates on their upper ends each with a centrally disposed aperture. Decking is supported by horizontal beams and defines a form to receive the concrete. The upper plates are masked and concrete is poured and screeded using the upper plates as screed guides, such that the upper surface of the concrete is generally flush with the upper surface of the upper plates. After removal of the masking, a set of upper posts having lower plates with centrally disposed pins are mounted atop the lower posts with the pins inserted into the apertures. The lower plates and upper plates are then welded to joint the lower and upper posts. The cycle is repeated for additional floors.

19 Claims, 4 Drawing Sheets

U.S. PATENT DOCUMENTS 6,009,674 A * 1/2000 Root ..... 52/167.3
6,073,401 A * 6/2000 Iri et al. ..... 52/79.1
6,119,413 A * 9/2000 Shaw et al. ..... 52/167.1
6,151,851 A 11/2000 Carter
6,578,343 B1 * 6/2003 Dumler et al. ..... 52/783.17
6,745,533 B1 * 6/2004 Yamashita et al. ..... 52/425

* cited by examiner

MULTI-STORY CONCRETE SLAB CONSTRUCTION

BACKGROUND OF THE INVENTION

This invention relates generally to a multi-story concrete slab construction system and method, and more particularly to such systems and methods wherein the upper story concrete slabs are poured in place to form the upper story floors and the framing elements are metal posts and beams that support horizontally extensive decking to receive the wet concrete.

It is well known to construct multi-story buildings utilizing concrete floors supported by an interconnected framework of either metal or concrete vertical post members and horizontal beam members. One methodology for constructing such buildings comprises the manufacture of prefabricated concrete slabs. The cured concrete slabs, typically manufactured off-site and transported to the building site, are lifted into position using cranes. The prefabricated slabs are usually provided with embedded connector means such that the slabs may be joined to the framework by mechanical fasteners, welding or similar methods. Examples of various systems using this methodology can be seen in U.S. Pat. No. 3,110,982 to Besinger, U.S. Pat. No. 3,378,971 to Singer et al., U.S. Pat. No. 3,594,971 to Hughes, U.S. Pat. No. 3,824,750 to Antoniou, U.S. Pat. No. 4,081,936 to Wise, U.S. Pat. No. 4,100,713 to Shoe, U.S. Pat. No. 4,330,970 to Bonink, U.S. Pat. No. 5,737,895 to Perrin, and U.S. Pat. No. 6,151,851 to Carter. While this type of construction has proven to be a successful approach, there are inherent drawbacks or problems. For example, off-site production of the prefabricated concrete slabs requires a separate production facility and the slabs must be transported to the building site. Cranes must be utilized to remove the slabs from the transport trucks and to position the slabs within the framework, which is inherently dangerous due to the size and weight of the concrete slabs. Securing the slabs to the framework requires many man-hours of labor. All of these factors contribute to lengthening the time of construction for even relatively simple multi-story buildings.

To address these and other problems encountered in the use of prefabricated concreter slabs for multi-story building construction, systems and methods have been developed whereby the upper level floors are poured in place one floor at a time on horizontally extending decking retained by the post and beam framework. The posts, beams and decking are erected for a first upper level floor, and the concrete is poured. The wet concrete is screeded either mechanically or by hand to provide the desired finish or upper surface. Upon curing, the posts, beams and decking for the next upper level floor are erected, the concrete is poured, finished and allowed to harden, and the next level is then erected. With this method a large number or even all the posts on a floor are joined horizontally by a monolithic concrete slab, thereby crating a laterally stabilized and rigid structure.

An example of this method is shown in U.S. Pat. No. 4,074,487 to Daniels et al. In this system, vertical load bearing members having triangular brace members are joined with horizontal joist members. The upper ends of the vertical posts comprise a male connector member. Support decking is then positioned on the joists with a portion of the vertical posts and the connector member extending above the decking. The concrete floor is then poured on the decking with only the connector members extending above the surface of the concrete. Once the concrete has cured, the next level of vertical posts is erected by inserting their lower ends on to the exposed connector members, and the process is repeated. The main problem with this poured-in-place method is that the connector members extend above the surface of the concrete and therefore care must be taken to cover the connector members or to otherwise insure that no concrete is deposited onto the connector members. The exposed connector members interfere with the screeding operations necessary to finish the surface of each floor and thereby significantly increase the man-hours necessary to complete each floor.

U.S. Pat. No. 5,444,957 to Roberts shows an alternate system for constructing a multi-story building using poured-in-place concrete floors that addresses the problem of the exposed connector members on the vertical posts. In the Roberts system, the top of the lower post member is provided with a horizontal flange or plate. Threaded bolts are inserted upwardly through the flange such that the threaded ends are positioned above the flange, with the bolts extending above the flange a distance sufficient to receive a bottom flange on the upper post to be supported as well as the securing nuts. The slab is then poured to a depth that completely covers the upper ends of the threaded bolts. Upon curing, the concrete situated above the flange on each post must be chipped away down to the flange, and the upper surface of the flange and the threaded bolts must be cleaned so that the upper posts can be positioned onto the lower posts and secured. This chipping and cleaning operation is labor and time intensive and may result in damage to the threaded bolts. In addition, since the head of the bolts are located beneath the flange and within the poured concrete, either the bolts must be individually welded to the underside of the flange or great care must be taken to insure that the bolt head is completely embedded within the concrete and that the concrete is completely cured prior to tightening of the nuts. If the bolt heads are not sufficiently restrained from turning, the bolts will rotate when the nuts are turned to secure the upper posts to the lower posts and there will be no way to correct this deficiency without chipping into the slab from the underside. Also, the chipping required to expose the bolts and flanges result in an unsightly crater surrounding each post, which must be filled in or covered.

It is therefore an object of this invention to provide a poured-in-place system and method for constructing upper level floors in multi-story buildings that addresses the problems and inefficiencies of the known methods and systems. It is an object of this invention to provide such a system and method whereby the vertical posts, horizontal beams and decking can be erected and the concrete poured such that the upper ends of the posts do not extend above the upper surface of the concrete slab, thereby allowing the slab to be easily screeded and finished. It is a further object to provide such a system and method whereby upon curing of the concrete slab the vertical posts of the next level are quickly and easily aligned onto the lower posts and secured by welding such that the support framework for the next floor level can be erected, and the procedure repeated as required to finish the multi-story building. These objects, as well as objects not expressly set forth, will be supported by and made clear from the disclosure set forth below.

SUMMARY OF THE INVENTION

The invention is in general both a method of construction and a system of construction for a multi-story building having a support framework comprising vertical post members, horizontal beam members and horizontally extensive decking, and poured-in-place concrete flooring. Multiple upper level floors are constructed by providing a plurality of vertical post members spaced at required intervals. The post members are of a height such that the upper end of the post member, which is formed by a generally planar, horizontally disposed flange or plate member, is positioned at the desired height for the finished upper surface of the upper concrete floor. The plates are provided with a centrally disposed aperture. The posts are inter-connected laterally near their upper ends by the beam members. Decking to receive the poured concrete is positioned on the horizontal beams, with a short upper segment of the vertical posts extending through the decking. The upper surfaces of the plates are masked by adhesive tape or similar means. The concrete is poured onto the decking and leveled by screeding, with the top surfaces of the plates serving as screed points for finishing the upper surface of the concrete. Once the concrete is sufficiently cured, the masking is removed from the plates to expose the apertures. The support posts for the next floor are then placed onto the plates of the lower support posts, the bottom of the upper posts each comprising a flange or plate member having an alignment pin extending therefrom which is inserted into the aperture of the exposed plate of the lower post. The bottom plate is then welded to the upper plate. The process is then repeated for each successive upper floor by attaching the beam members, positioning the deck members, masking, pouring the concrete, etc.

DETAILED DESCRIPTION OF THE INVENTION

With reference to the drawings, the invention will now be described in detail with regard for the best mode and preferred embodiment. In general, the invention is a structural system for a multi-story building comprising a number of combined elements and members, and the method of constructing such structural system. More particularly, the invention is such a structural system and method involving a support framework combining vertical post members, horizontal beam members, laterally extensive decking and a poured-in-place concrete floor for at least one upper story of the building above ground level.

Figure 1:
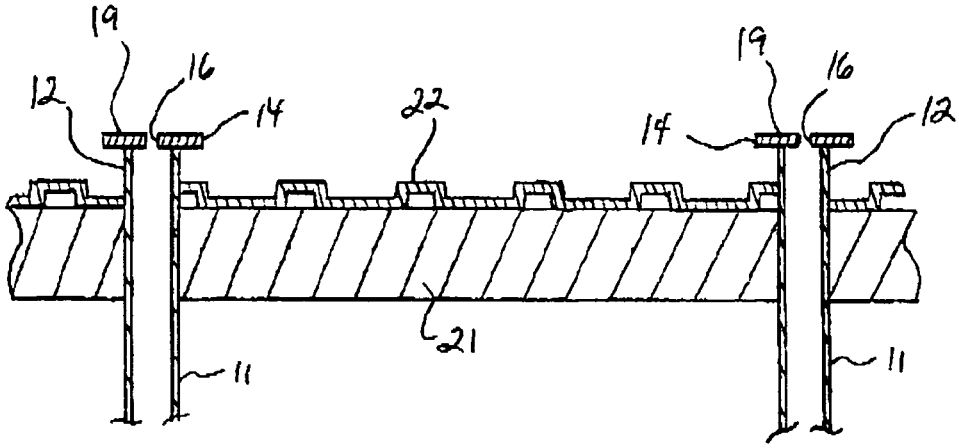
FIG. 1 is a cross-sectional plan view taken along line I—I of FIG. 2, showing a pair of vertical post members, the connecting horizontal beams and the decking to receive the concrete, shown prior to the pouring of the concrete.
Figure 2:
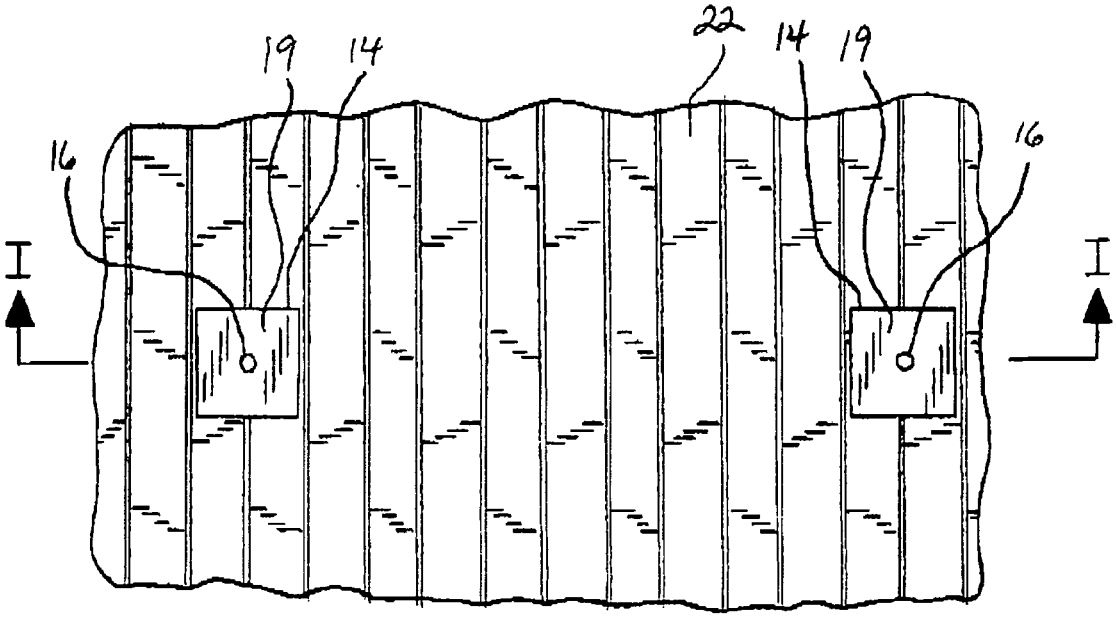
FIG. 2 is a top view showing the upper plate members of a pair of post members and the exposed decking prior to pouring of the concrete.

A horizontal foundation slab, typically formed of concrete, is provided to create the ground floor of the multi-story building in known manner. A plurality of vertical post members 11 are secured to or embedded in the foundation in required manner under engineering codes, the post members 11 having sufficient load bearing characteristics as required for the building to be constructed and to support at least a first floor above the ground floor. As shown in the figures, the post members 11 are preferably composed of square profile steel tubing, a representative size that has been found suitable in application being approximately 3.5 inches by 3.5 inches and having a wall thickness of approximately 0.25 inches. Joined to the upper end 12 of each of these post members 11 is an upper flange or plate member 14 having a generally planar and horizontal upper surface 19. A steel upper plate member 14 having a thickness of approximately 0.5 inches welded to the upper end 12 of the post members 11 has been found to be suitable, with the lateral dimensions of the plate member 14 most preferably being such that the plate member 14 extends a short distance beyond the outer perimeter of the post member 11. The length of the lower post members 11 is chosen such the plate upper surface 19 is disposed at the precise height desired for the upper floor surface 24 of the upper concrete floor 23, in that the plate upper surface. Horizontal beam members 21, such as for example steel I-beams, are secured adjacent to or at the post upper ends 12, typically initially by mechanical fasteners followed by welding to increase the lateral stability of the framework. The horizontal beam members 21 support the laterally extensive decking 22, which is composed of a material of suitable strength capable of acting as a form to receive the wet concrete. Typically the decking 22 is erected by overlapping a plurality of corrugated sheet metal members or similar material on top of the horizontal beam members 21, with portions of the decking 22 being cut-out to allow the post upper ends 12 and upper plate members 14 to protrude through and above the decking 22, as shown in FIGS. 1 and 2.

The upper plate members 14 are each provided with an alignment hole or aperture 16, most preferably centrally disposed on the vertical longitudinal axis of the post member 11. Prior to performance of the concrete pouring step, the plate upper surfaces 19 and alignment apertures 16 are covered or masked by a thin, removable covering or masking member 31, such as for example masking or duct tape, to preclude adherence of concrete to the plate upper surfaces 19 and blockage of alignment apertures 16, as shown on the left plate member 14 in FIGS. 1 and 2. Wet concrete is then delivered in known manner onto the decking 22, in amount sufficient such that the upper surface 24 of the finished concrete floor 23 resides flush with the plate upper surfaces 19. With this construction, the masked plate upper surfaces 19 not only do not interfere with the screeding process, enabling the first floor to be finished much more rapidly than constructions that have upwardly protruding structural elements, but the masked plate upper surfaces 19 themselves act as screed guides or points for leveling the wet concrete, such that a level floor surface 24 at the proper elevation is easily obtained.

Figure 3:
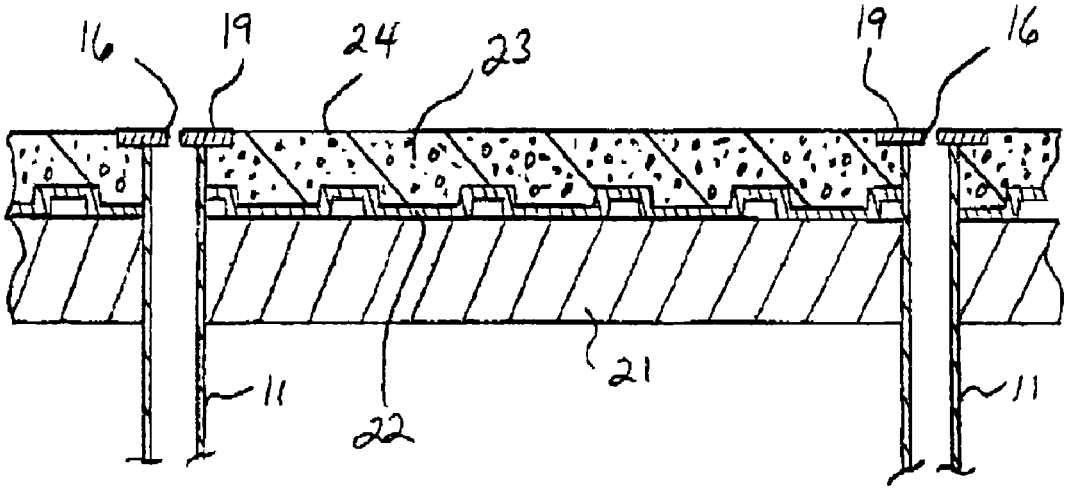
FIG. 3 is a cross-sectional view similar to FIG. 1, showing the structure after the pouring of the concrete, the removal of the masking member and the screeding of the concrete.
Figure 4:
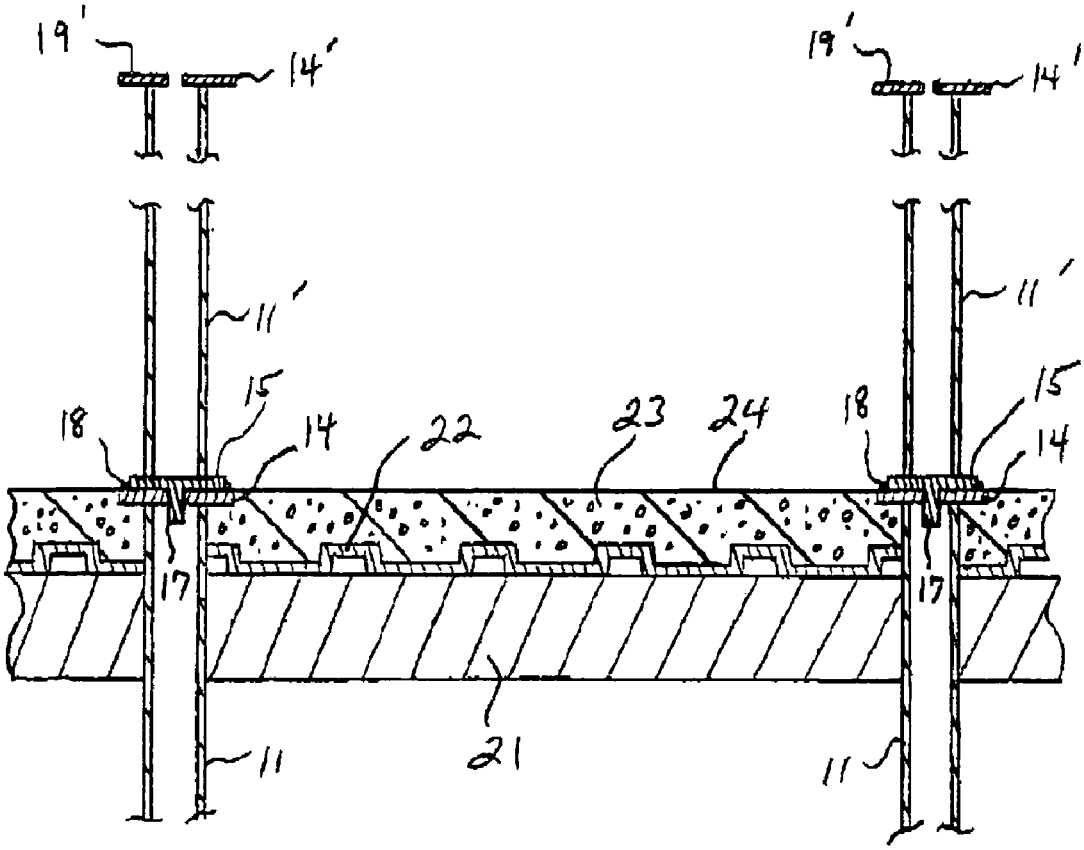
FIG. 4 is a cross-sectional view similar to FIG. 1, showing the structure after the upper level post members have been joined to the lower level post members.
Figure 5:
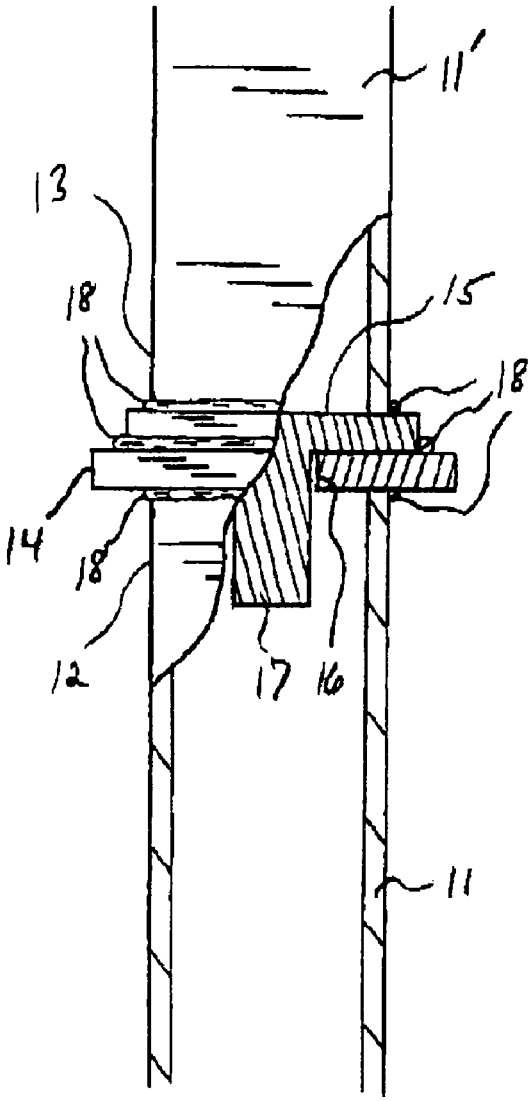
FIG. 5 is a partial cross-sectional view showing one embodiment for connection of the upper post member to the lower post member.
Figure 6:
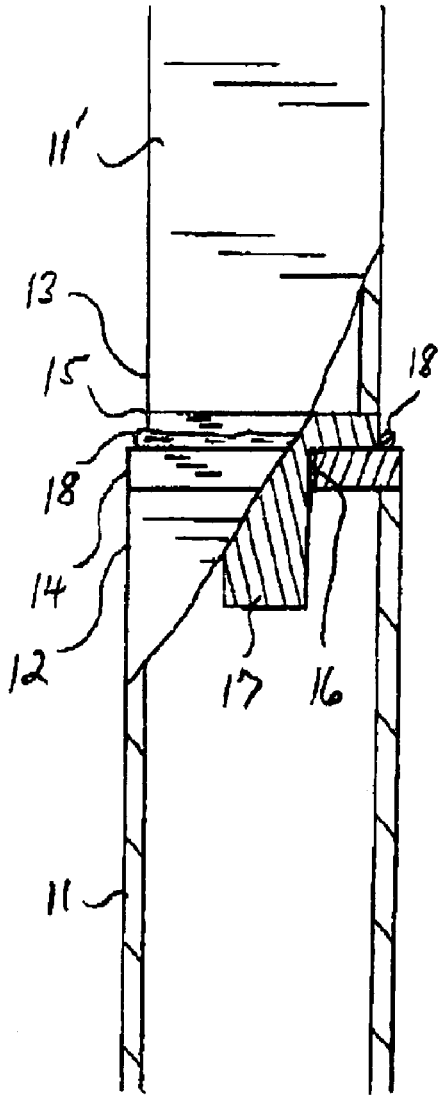
FIG. 6 is a partial cross-sectional view showing an alternative embodiment for connection of the upper post member to the lower post member.
Figure 7:
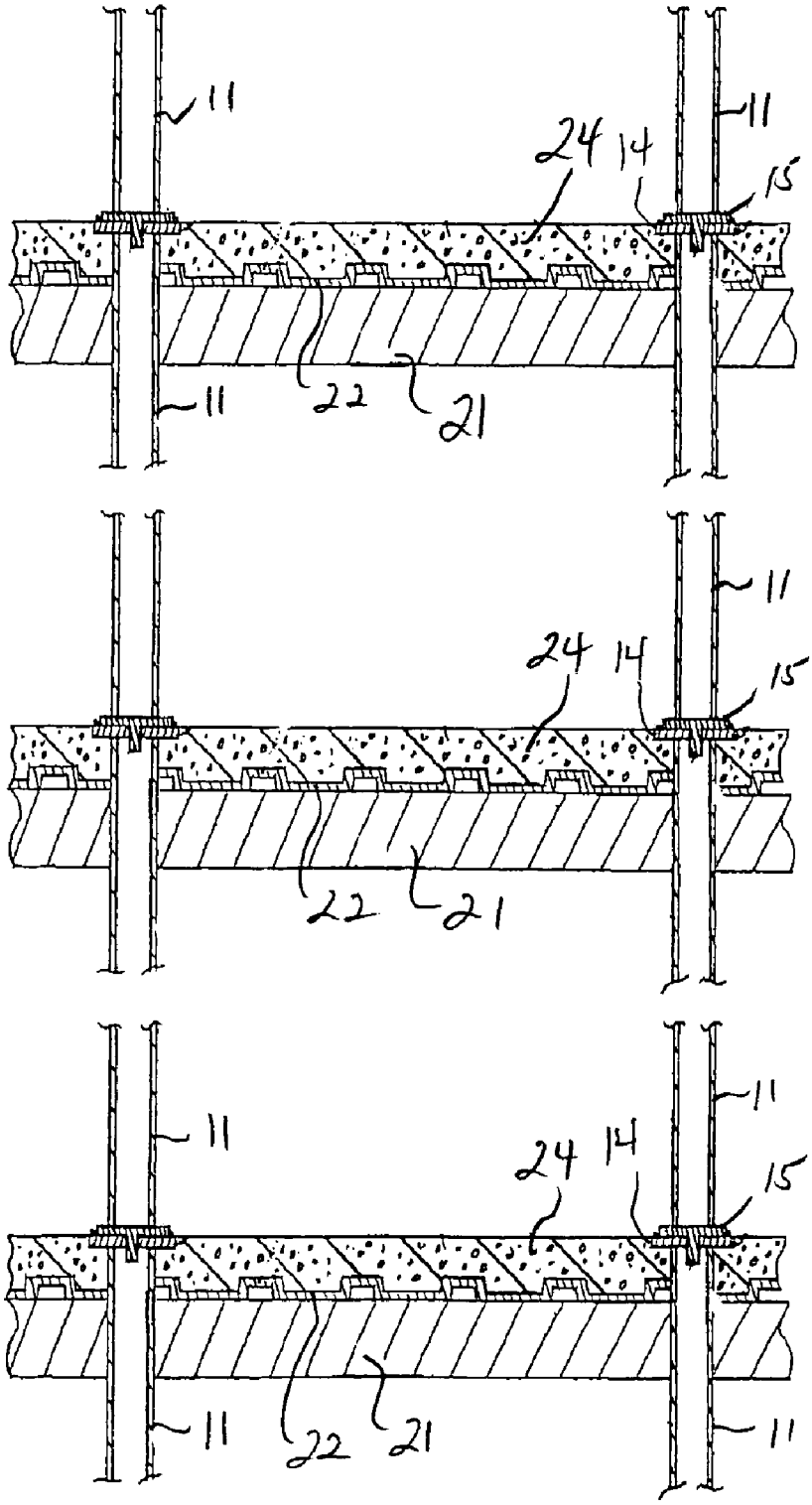
FIG. 7 is a view showing multiple stories.

When the concrete floor 23 has sufficiently hardened to allow work to be performed thereon, the masking members 31 are removed to expose the clean plate upper surfaces 19 and the alignment apertures 16, as shown in FIG. 3. The upper post members 11' for the second floor are then erected atop the lower post members 11, as shown in FIG. 4. The upper post members 11' are preferably of similar construction and composition to the lower post members 11, although they may be of different dimensions if desired. Each upper post member 11' comprises a lower plate member 15 and, if additional upper floors 23 are to be added, an upper plate member 14'. The lower plate members 15 are preferably of smaller horizontal dimensions than the upper plate member 14, such that a weld 18 of sufficient thickness may be provided to secure the lower plate member 15 and upper post member 11' to the upper plate member 14 and lower post member 11. As before, the height of the upper post member 11' is chosen such that the plate upper surface 19', will reside at the desired elevation for the upper floor surface of the next story.

Each lower plate member 15 is provided with an alignment post or pin member 17 having a configuration and diameter slightly smaller than the diameter of the alignment aperture 16 in the upper plate member 14. For example, for an alignment aperture 16 having a diameter of approximately 1.125 inches, a diameter of approximately 1 inch is suitable for the alignment pin member 17. The combination of the aperture 16 and the pin member 17 enable each upper post member 11' to be quickly positioned atop a lower post member 11, the difference in diameters allowing easy insertion of the pin member 17 and also allowing easy lateral movement for precise alignment. Once the upper post member 11' is properly plumbed and aligned, it is then permanently joined to the lower post member 11. For multiple story buildings having a second floor, third floor, etc., the process and structure is repeated for each floor.

It is understood that equivalents and substitutions for elements set forth above may be obvious to those skilled in the art, and therefore the full scope and definition of the invention is to be as set forth in the following claims.

We claim:

1. A floor system in a multi-story building comprising:

a set of vertical lower post members, each said lower post member having a horizontal upper plate member with an aperture and an upper surface;

horizontal beam members connected to said lower post members;

horizontally extensive decking positioned on said beam members, said decking being positioned below said upper plate members;

poured-in-place concrete on said decking member defining a concrete slab first floor above ground level, said first floor having an upper surface flush with said upper surfaces of said upper plate members;

a set of upper post members joined to said lower post members, said upper post members having a horizontal lower plate member with an alignment pin member, whereby said alignment pin members are positioned within said apertures and said lower plate members are welded to said upper plate members.

2. The system of claim 1, further comprising:

horizontal upper plate members positioned on each of said upper post members, said upper plate members each having an aperture and an upper surface;

horizontal beam members connected to said upper post members;

horizontally extensive decking positioned on said beam members, said decking being positioned below said upper post upper plate members;

poured-in-place concrete on said decking member defining a concrete slab second floor above ground level, said second floor having an upper surface flush with said upper surfaces of said upper post upper plate members;

a set of third floor upper post members joined to said upper post members, said third floor upper post members having a horizontal lower plate member with an alignment pin member, whereby said alignment pin members are inserted into said apertures and said lower plate members of said third floor upper post members are welded to said upper plate members of said upper post members.

3. The system of claim 1, wherein said apertures in said upper plate members and said pin members in said lower plate members are centrally disposed.

4. The system of claim 2, wherein said apertures in said lower post upper plate members and said upper post upper plate members are centrally disposed, and said pin members in said upper post lower plate members and said third floor upper post lower plate members are centrally disposed.

5. The system of claim 3, wherein said pin members have a smaller diameter than said apertures, such that said upper post members can be shifted laterally for alignment with said lower post members.

6. The system of claim 4, wherein said pin members have a smaller diameter than said apertures, such that said upper post members can be shifted laterally for alignment with said lower post members and such that said third floor upper post members can be shifted laterally for alignment with said upper post members.

7. The system of claim 1, wherein said lower post members and said upper post members are composed of square profile steel tubing.

8. The system of claim 2, wherein said lower post members and said upper post members are composed of square profile steel tubing.

9. The system of claim 7, wherein said decking is composed of corrugated sheet metal.

10. The system of claim 8, wherein said decking is composed of corrugated sheet metal.

11. The system of claim 1, wherein said upper plate members are larger than said lower plate members.

12. A floor system in a multi-story building comprising:

a set of vertical lower post members, each said lower post member having an upper end, a horizontal upper plate member with an aperture and an upper surface;

horizontal beam members connected to said lower post members near said upper ends;

horizontally extensive decking positioned on said beam members, said decking being positioned below said upper plate members, wherein said upper ends extend through and above said decking;

poured-in-place concrete on said decking member defining a concrete slab first floor above ground level, said first floor having an upper surface flush with said upper surfaces of said upper plate members whereby said upper ends of said lower post members, said upper plate members and said decking are embedded or bonded to said concrete slab first floor;

a set of upper post members joined to said lower post members, said upper post members having a horizontal lower plate member with an alignment pin member, whereby said alignment pin members are positioned within said apertures and said lower plate members are welded to said upper plate members.

13. The system of claim 12, wherein said upper post members comprise upper ends, and further comprising:

horizontal upper plate members positioned on said upper ends of each of said upper post members, said upper plate members each having an aperture and an upper surface;

horizontal beam members connected to said upper post members near said upper ends;

horizontally extensive decking positioned on said beam members, said decking being positioned below said upper post upper plate members, wherein said upper ends extend through and above said decking;

poured-in-place concrete on said decking member defining a concrete slab second floor above ground level, said second floor having an upper surface flush with said upper surfaces of said upper post upper plate members whereby said upper ends of said lower post members, said upper plate members and said decking are embedded or bonded to said concrete slab second floor;

a set of third floor upper post members joined to said upper post members, said third floor upper post members having a horizontal lower plate member with an alignment pin member, whereby said alignment pin members are inserted into said apertures and said lower plate members of said third floor upper post members are welded to said upper plate members of said upper post members.

14. The system of claim 12, wherein said apertures in said upper plate members and said pin members in said lower plate members are centrally disposed.

15. The system of claim 13, wherein said apertures in said lower post upper plate members and said upper post upper plate members are centrally disposed, and said pin members in said upper post lower plate members and said third floor upper post lower plate members are centrally disposed.

16. The system of claim 15, wherein said pin members have a smaller diameter than said apertures, such that said upper post members can be shifted laterally for alignment with said lower post members.

17. The system of claim 15, wherein said pin members have a smaller diameter than said apertures, such that said upper post members can be shifted laterally for alignment with said lower post members and such that said third floor upper post members can be shifted laterally for alignment with said upper post members.

18. The system of claim 16, wherein said decking is composed of corrugated sheet metal.

19. The system of claim 17, wherein said decking is composed of corrugated sheet metal.

* * * * *